US009775761B2

(12) United States Patent
McLaughlin et al.

(10) Patent No.: US 9,775,761 B2
(45) Date of Patent: Oct. 3, 2017

(54) COMPARTMENTALIZED CREMATION URN SYSTEM FOR RETAINING MULTIGENERATIONAL CREMAINS OF HUMANS AND/OR PETS

(71) Applicants: Margie McLaughlin, Philadelphia, PA (US); John Henry Williams, Jr., Philadelphia, PA (US)

(72) Inventors: Margie McLaughlin, Philadelphia, PA (US); John Henry Williams, Jr., Philadelphia, PA (US)

(73) Assignees: Margie McLaughlin; John Henry Williams, Jr.

( * ) Notice: Subject to any disclaimer, the term of this patent is extended or adjusted under 35 U.S.C. 154(b) by 0 days.

(21) Appl. No.: 15/434,328

(22) Filed: Feb. 16, 2017

(65) Prior Publication Data

US 2017/0239122 A1 Aug. 24, 2017

Related U.S. Application Data

(60) Provisional application No. 62/297,645, filed on Feb. 19, 2016.

(51) Int. Cl.
*A61G 17/08* (2006.01)

(52) U.S. Cl.
CPC ..... *A61G 17/08* (2013.01)

(58) Field of Classification Search
CPC ..... A61G 17/08; E04H 13/008; A47G 1/143; A47G 1/1065
USPC ..... 27/1; 40/124.5, 377, 729, 734, 747
See application file for complete search history.

(56) References Cited

U.S. PATENT DOCUMENTS 3,959,903 A * 6/1976 Shneider ..... G09F 11/08 40/377
4,199,848 A * 4/1980 Kohnert ..... A61G 17/08 27/1
5,349,727 A * 9/1994 Niebergall ..... A61G 17/007 220/528
5,433,036 A * 7/1995 Ganal ..... G09F 1/10 40/729
5,787,625 A * 8/1998 Yesbick ..... G09F 15/0006 40/124.5
5,832,575 A * 11/1998 Sturino ..... A61G 17/08 27/1
5,896,632 A * 4/1999 Sturino ..... A61G 17/08 27/1
5,950,288 A * 9/1999 Bach Lahor ..... A61G 17/08 27/1

(Continued)

*Primary Examiner* — William Miller

(57) ABSTRACT

A compartmentalized cremation urn and system for retaining multigenerational cremains of humans and/or pets is provided. The multigenerational cremation urn may store multigenerational cremains in a single compartmentalized container as well as showcase images of the deceased. A removable lid is provided. The lid in a closed condition over the compartmentalized container may highlight a view area of the cremains. An image carousel may be provided on the top of the lid. The image carousel may provide a plurality of radially extending display frames for housing images capturing the memories of those inurned in the multigenerational cremation, wherein a user may selectively rotate the image carousel for viewing a lineage of loved ones of humans and/or pets across multiple generations.

8 Claims, 3 Drawing Sheets

(56) References Cited

U.S. PATENT DOCUMENTS

| | | | | |
|---|---|---|---|---|
| 6,526,636 | B2 * | 3/2003 | Bernhardt | E04H 13/008 27/1 |
| 6,735,831 | B1 * | 5/2004 | Greiwe | A61G 17/08 27/1 |
| 7,082,653 | B1 * | 8/2006 | Sueppel | A47G 1/0616 27/1 |
| 7,117,570 | B1 * | 10/2006 | Borgerding | A61G 17/08 27/1 |
| 7,191,499 | B2 * | 3/2007 | Davis | A61G 17/08 27/1 |
| 7,373,703 | B1 * | 5/2008 | Grenci | A61G 17/08 27/1 |
| 7,562,423 | B2 * | 7/2009 | Pryd-Kakuk | A61G 17/08 27/1 |
| 7,793,393 | B2 * | 9/2010 | Roberts | A61G 17/08 27/1 |
| 8,046,881 | B2 * | 11/2011 | Johnson | A61G 17/08 27/1 |
| 8,146,216 | B2 * | 4/2012 | Creager | A61G 17/08 27/1 |
| 8,341,812 | B2 * | 1/2013 | Kocir | A61G 17/08 27/1 |
| 8,707,526 | B2 * | 4/2014 | Cooke | A61G 17/08 27/1 |
| 8,935,837 | B2 * | 1/2015 | Jairala, Jr. | A61G 17/08 27/1 |
| 2005/0144821 | A1 * | 7/2005 | Griesemer | A47G 1/14 40/546 |
| 2006/0207075 | A1 * | 9/2006 | Davis | A61G 17/08 27/1 |
| 2010/0011631 | A1 * | 1/2010 | Thompson | G09F 19/00 40/1 |

* cited by examiner

COMPARTMENTALIZED CREMATION URN SYSTEM FOR RETAINING MULTIGENERATIONAL CREMAINS OF HUMANS AND/OR PETS

CROSS-REFERENCE TO RELATED APPLICATION

This application claims the benefit of priority of U.S. provisional application No. 62/297,645, filed 19 Feb. 2016, the contents of which are herein incorporated by reference.

BACKGROUND OF THE INVENTION

The present invention relates to cremation urns and memorial displays and, more particularly, to a cremation urn and system for retaining multigenerational cremains.

The problem of memorializing multiple generations of deceased ones is that current cremation urns are design for one individual or one pet, and so memorializing multiple generations requires accumulating multiple stand-alone cremation urns. Besides the lack of convenience, such physically separated urns can be disconcerting to survivors who see the inherent connectedness and unity across the generations of passed beloved. As a result, stockpiling urn after urn, generation after generation can impose an emotional as well as physical strain.

As can be seen, there is a need for a cremation urn for systematically retaining multigenerational cremains of both humans and/or pets. The present invention stores multigenerational cremains in a single compartmentalized container for showcasing images of the deceased, within a carousel-like turnstile which is affixed to the Lid thereby showcasing and keeping the legacy of deceased ones alive and united in a greater sense while memorializing the everlasting heritage of the deceased through a carousel image display.

SUMMARY OF THE INVENTION

In one aspect of the present invention, multigenerational cremation urn provides a container providing a plurality of transparent sidewalls enclosing a space, wherein each sidewall has a height of at least five inches; an opaque lid dimensioned to slide over the plurality of sidewalls between an open condition and a closed condition, wherein the closed condition approximately two inches of the height of each sidewall is still visible; and an image carousel rotatably connected to an outer top portion of the lid, wherein the image carousel provides a plurality of display frames, each display frame adapted to removably house two captured image.

In another aspect of the present invention, the multigenerational cremation urn provides a container having a plurality of transparent sidewalls enclosing a space, wherein each sidewall has a height of approximately seven inches; a plurality of dividers partitioning the space into a plurality of compartments; an opaque lid dimensioned to slide over the plurality of sidewalls between an open condition and a closed condition, wherein the closed condition approximately two inches of the height of each sidewall is still visible; and an image carousel, wherein the image carousel further includes: an axle connected to the outer top portion of the lid; a hub rotatably engaged with the axle; and a plurality of display frames radially extending from the hub, wherein each display frame is adapted to house two opposite-face captured images.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a cremation urn and system for retaining multigenerational cremains. The multigenerational cremation urn may store multigenerational cremains in a single compartmentalized container which also showcases images of the deceased. A removable lid is provided. The lid in a closed condition over the compartmentalized container may highlight a view area of the cremains. An image carousel may be provided on the top of the lid. The image carousel may provide a plurality of radially extending display frames for housing images capturing the memories of those inurned in the multigenerational cremation, wherein a user may selectively rotate the image carousel for viewing a lineage of loved ones across multiple generations.

Figure 1:
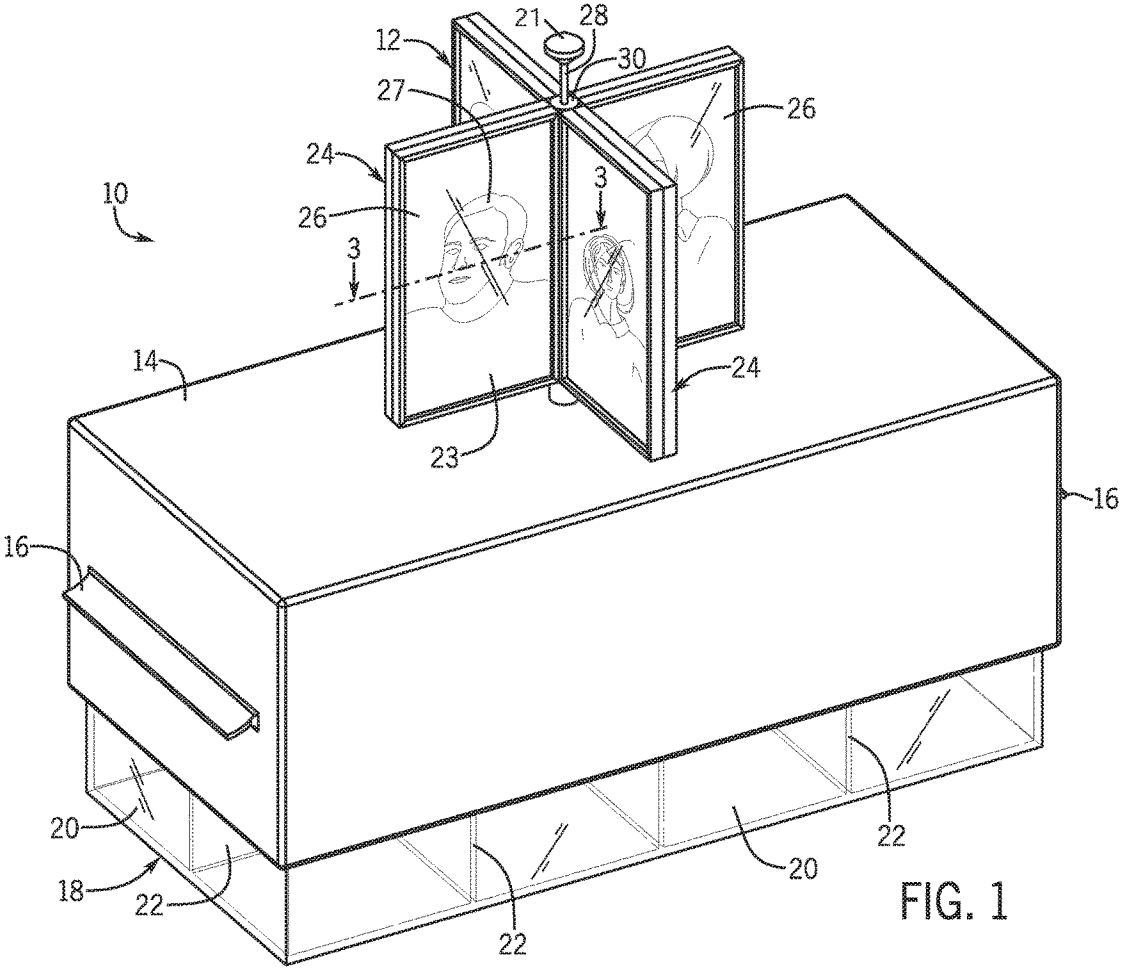
FIG. 1 is a front perspective view of an exemplary embodiment of the present invention, wherein the lid is in a closed condition.
Figure 2:
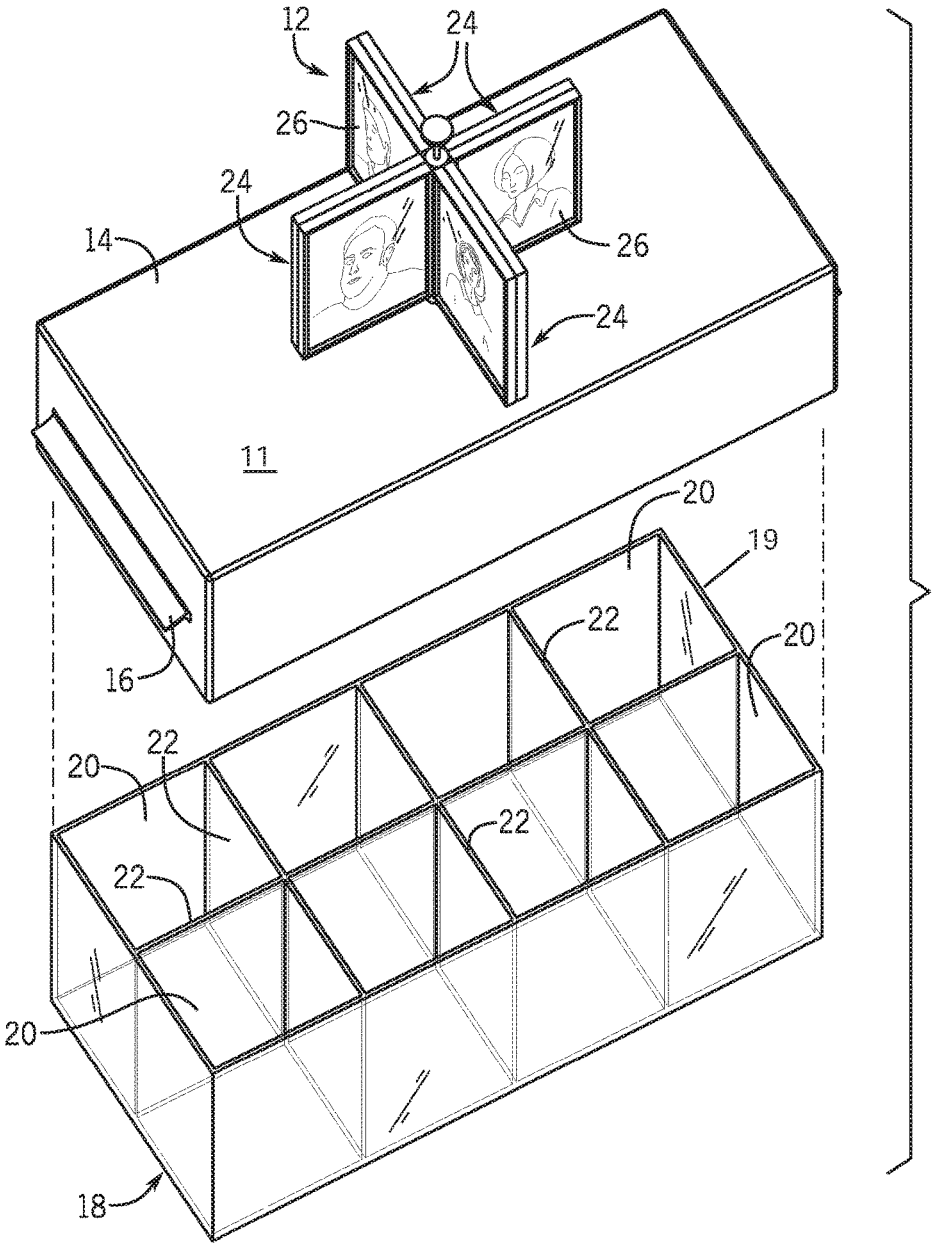
FIG. 2 is an exploded perspective view of an exemplary embodiment of the present invention.
Figure 3:
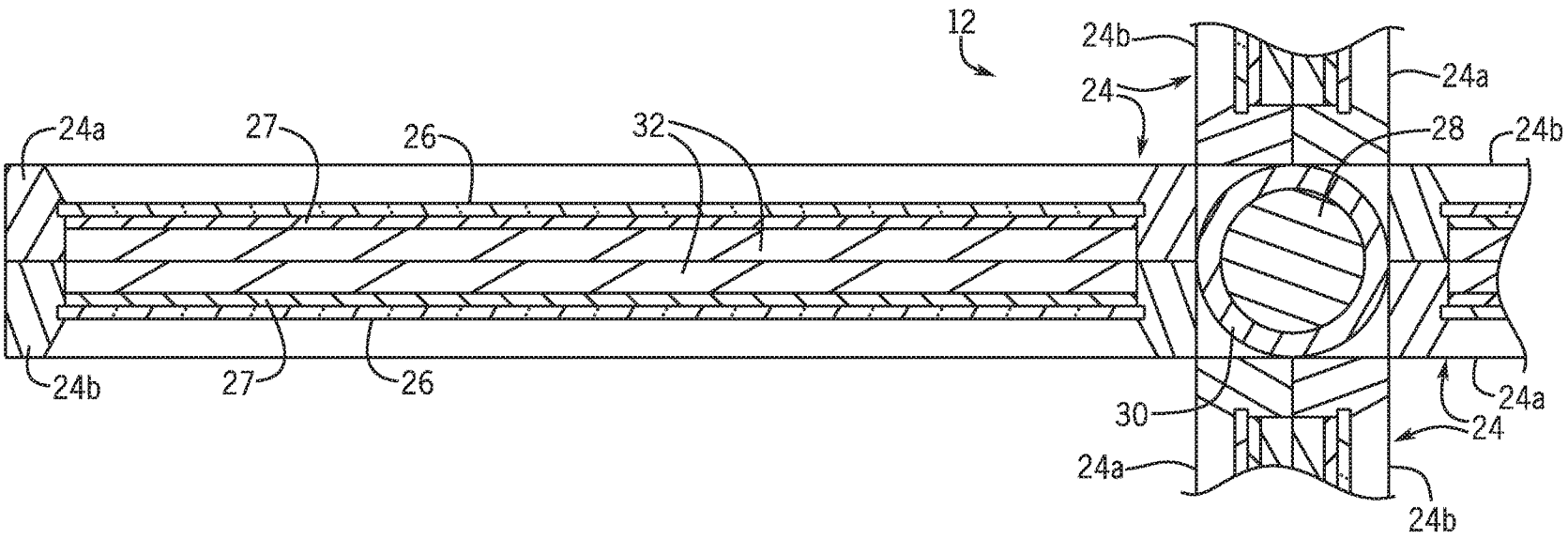
FIG. 3 is a cross sectional view of an exemplary embodiment of the present invention, taken along line 3-3 of FIG. 1.

Referring to FIGS. 1 through 3, the present invention may include a multigenerational cremation urn 10 providing a container 18 and a lid 14. Within the container 18 a plurality of compartments 20 are partitioned off by dividers 22. The container 18 may provide transparent sidewalls 19, whereby the compartments 20 are visible therethrough.

The lid 14 may provide handles 16 for facilitating moving the lid 14 between an open condition and a closed condition over a top portion of the sidewalls 19. The lid 14 may be dimensioned and adapted to slide over the sidewalls 19 so as that in the closed condition a viewing space of a lower portion of the compartments 20 is still visible through the sidewalls 19, as illustrated in FIG. 1. In certain embodiments, the container 18 may have glass sidewalls 19 defining an approximate 14.75"×7" in height×6.75" in depth space that is evenly sectioned to eight compartments 20 by the dividers 22. In this case, the lid 14 would have an effective height of 5" so as to provide an approximately two inch viewing area with the lid 14 is in the closed condition.

Along an outer top surface 11 of the lid 14, an image carousel 12 may be provided. The image carousel 12 may include an axle 28 extending from the outer top surface 11, in certain embodiments, from near the center of the outer top surface 11. A hub 30 may rotatably engage the axle 28.

A plurality of image frames 24 may radially extend from the hub 30. In certain embodiments, the image frames 24 may be evenly spaced along the hub 30, for example there may be four image frames 24 spaced ninety degrees apart.

Each image frame 24 may have opposite-facing display frames, such as a first display frame 24*a* and a second display frame 24*b*, as illustrated in FIG. 3.

Each display frame 24*a* and 24*b* may provide a pocket into which a captured image 27 can slide between a transparent front plate 26 and a backing plate 32. In certain embodiments, the captured images 27 will be of or memorial to loved ones inurned in one or more of the plurality of compartments 20. A post and knob 21 may be connected to the hub 30 for selectively rotating the plurality of image frames 24.

A method of using the present invention may include the following. The multigenerational cremation urn 10 disclosed above may be provided. With the lid 14 removed, a user may fill at least one of the compartments 20 with the remains of a beloved individual or pet, and then slide a captured image 27 of their beloved in at least one of the display frames 24. Then using the handles 16, the user may slide the lid 14 into the closed condition, revealing the viewing area at the bottom of the multigenerational cremation urn 10. The user may then rotate the turnstile housing of the image carousel 12, showcasing the associated the captured image 27 as desired. In certain embodiments, the image carousel 12 may be detachable.

Besides or in addition to storing remains, the compartments 20 may be used to store memorabilia of those who have passed.

It should be understood, of course, that the foregoing relates to exemplary embodiments of the invention and that modifications may be made without departing from the spirit and scope of the invention as set forth in the following claims.

What is claimed is:

1. A multigenerational cremation urn, comprising:

a container providing a plurality of transparent sidewalls enclosing a space for retaining cremains, wherein each sidewall has a height of at least seven inches;

an opaque lid dimensioned to slide vertically over the plurality of sidewalls between an open condition and a closed condition, wherein in the closed condition only approximately two inches of the height of each sidewall is still visible; and an image carousel rotatably connected to an outer top portion of the lid, wherein the image carousel provides four dual-face display frames, each display frame adapted to removably house two captured images.

2. The multigenerational cremation urn of claim 1, further comprising a plurality of dividers partitioning the space into a plurality of compartments.

3. The multigenerational cremation urn of claim 1, wherein the height of each sidewall is approximately seven inches.

4. The multigenerational cremation urn of claim 1, wherein the image carousel further comprises:

an axle connected to the outer top portion of the lid;

a hub rotatably engaged with the axle; and wherein each display frame radially extends from the hub.

5. The multigenerational cremation urn of claim 1, further comprising a knob connected to the hub for selectively rotating the plurality of display frames.

6. The multigenerational cremation urn of claim 1, wherein the two captured images are two opposite-face captured images.

7. A multigenerational cremation urn, comprising:

a container providing a plurality of transparent sidewalls enclosing a space for retaining cremains, wherein each sidewall has a height of approximately seven inches;

a plurality of dividers partitioning the space into a plurality of compartments;

an opaque lid dimensioned to slide vertically over the plurality of sidewalls between an open condition and a closed condition, wherein in the closed condition only approximately two inches of the height of each sidewall is still visible; and an image carousel, wherein the image carousel comprises:

an axle connected to an outer top portion of the lid;

a hub rotatably engaged with the axle; and a plurality of display frames radially extending from the hub, wherein each display frame is adapted to house two opposite-face captured images.

8. The multigenerational cremation urn of claim 7, further comprising a knob connected to the hub for selectively rotating the plurality of display frames.

* * * * *